US005190430A

United States Patent [19]

Neri et al.

[11] Patent Number: 5,190,430

[45] Date of Patent: Mar. 2, 1993

[54] APPARATUS FOR FEEDING PACKAGING MACHINES WITH STACKS OF SHEET MATERIAL

[75] Inventors: Armando Neri, Bologna; Mario Turra, Casalecchio Di Reno, both of Italy

[73] Assignee: G. D. S.p.A., Bologna, Italy

[21] Appl. No.: 558,550

[22] Filed: Jul. 27, 1990

[30] Foreign Application Priority Data

Aug. 1, 1989 [IT] Italy ..... 3575 A/89
May 8, 1990 [IT] Italy ..... 3484 A/90

[51] Int. Cl.[5] ..... B72D 7/02; B65B 69/00

[52] U.S. Cl. ..... 414/412; 83/909; 414/796.9; 414/797

[58] Field of Search ..... 83/909, 142, 425; 29/426.4, 564.3; 414/751, 752, 753, 792.9, 796.9, 797, 411, 403, 412, 422, 929

[56] References Cited

U.S. PATENT DOCUMENTS

| | | | |
|---|---|---|---|
| 3,542,241 | 11/1970 | Middleditch | 414/797 X |
| 3,884,363 | 5/1975 | Ajouny | 414/626 |
| 4,328,609 | 5/1982 | Born | 83/909 X |
| 4,414,730 | 11/1983 | Ohmura et al. | 83/909 X |
| 4,553,312 | 11/1985 | Mitzel et al. | 83/909 X |
| 4,592,692 | 6/1986 | Suizu et al. | 414/792.9 X |
| 4,660,818 | 4/1987 | Conner et al. | 83/909 X |
| 4,838,751 | 6/1989 | Hanaya et al. | 83/909 X |
| 4,911,608 | 3/1990 | Krappitz et al. | 414/796.9 X |
| 4,976,583 | 12/1990 | Moltrasio | 414/797 X |
| 4,995,784 | 2/1991 | Boisseau | 83/909 X |

FOREIGN PATENT DOCUMENTS

| | | | |
|---|---|---|---|
| 0086280 | 8/1983 | European Pat. Off. . | |
| 2847164 | 5/1979 | Fed. Rep. of Germany | 414/796.9 |
| 3439908 | 4/1986 | Fed. Rep. of Germany . | |
| 2239401 | 2/1975 | France | 414/797 |
| 0059475 | 5/1977 | Japan | 414/792.9 |
| 0105821 | 5/1987 | Japan | 414/751 |
| 8912018 | 12/1989 | PCT Int'l Appl. | 414/751 |
| 1551957 | 9/1979 | United Kingdom . | |
| 2203723 | 10/1988 | United Kingdom | 414/796.9 |

*Primary Examiner*—Frank E. Werner
*Assistant Examiner*—James T. Eller, Jr.
*Attorney, Agent, or Firm*—Guido Modiano; Albert Josif

[57] ABSTRACT

The apparatus for feeding packaging machines with stacks of sheet material has a unit for the removal and transfer of stacks of sheet material which are arranged mutually side by side on supports and are individually wrapped by respective bands. The removal and transfer unit has a head which is vertically and horizontally movable and has grip elements for removing individual stacks from the supports and for transferring them to a feeding station of the packaging machine. A station for cutting the band is arranged ahead of the feeding station.

12 Claims, 4 Drawing Sheets

APPARATUS FOR FEEDING PACKAGING MACHINES WITH STACKS OF SHEET MATERIAL

BACKGROUND OF THE INVENTION

The present invention relates to an apparatus for feeding packaging machines with stacks of sheet material, in particular cardboard cutouts for rigid cigarette packets.

As known, cigarette packaging machines are fed with stacks of cardboard cutouts intended to constitute the outer container of the cigarette packets.

The stacks of cardboard cutouts are arranged on a belt conveyor which advances with a stepwise motion so as to convey said stacks to means which transfer the individual cardboard cutouts to a processing line of the machine.

The stacks of cutouts are currently arranged manually on the input conveyor of the packaging machine.

The conveyor in turn supplies a tank which feeds a stripper element adapted for separating the individual cutouts to be transferred to the machine processing line.

This feeding system is rather complicated and limits the productivity of the machine besides entailing a considerable cost in labor.

SUMMARY OF THE INVENTION

The aim of the present invention is to solve the above described problem by providing an apparatus for feeding packaging machines with stacks of cardboard cutouts in a completely automatic manner.

A further object of the present invention is to provide an apparatus which is simple in concept, safely reliable in operation and versatile in use.

According to the present invention, an apparatus for feeding packaging machines with stacks of sheet material is provided, said apparatus being characterized in that it comprises a unit for the removal and transfer of stacks of sheet material which are arranged side by side on supporting means and are individually wrapped by respective bands, said removal and transfer unit having a head provided with grip elements for gripping a stack and being movable vertically and horizontally so as to be positionable at the individual stacks and subsequently movable to a station for feeding said sheet material to the packaging machine, and a cutting station for cutting said wrapping band, said cutting station being arranged ahead of said station for feeding to the packaging machine.

BRIEF DESCRIPTION OF THE DRAWINGS

The invention is now described with reference to the accompanying illustrative, non-limitative drawings, wherein:

FIG. 2' is a plan view of the detail of FIG. 2;

DESCRIPTION OF THE PREFERRED EMBODIMENTS

Figure 2:
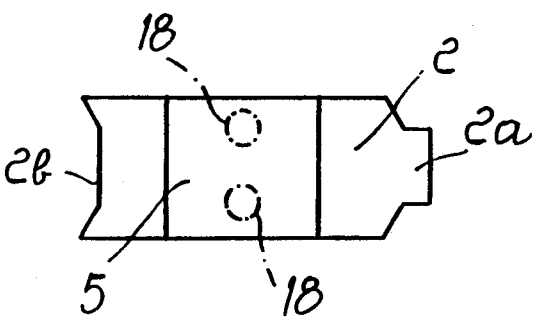
FIG. 2 is a front view of a detail of FIG. 1.
Figure 2:
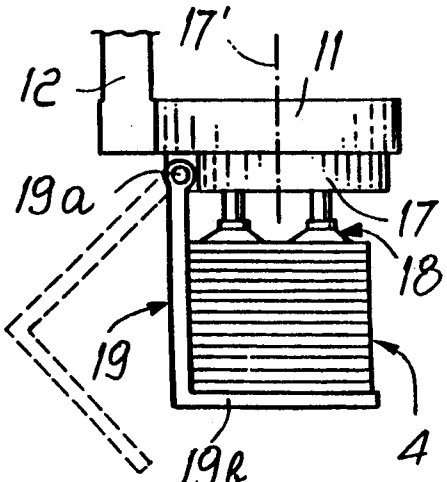
Figure 1:
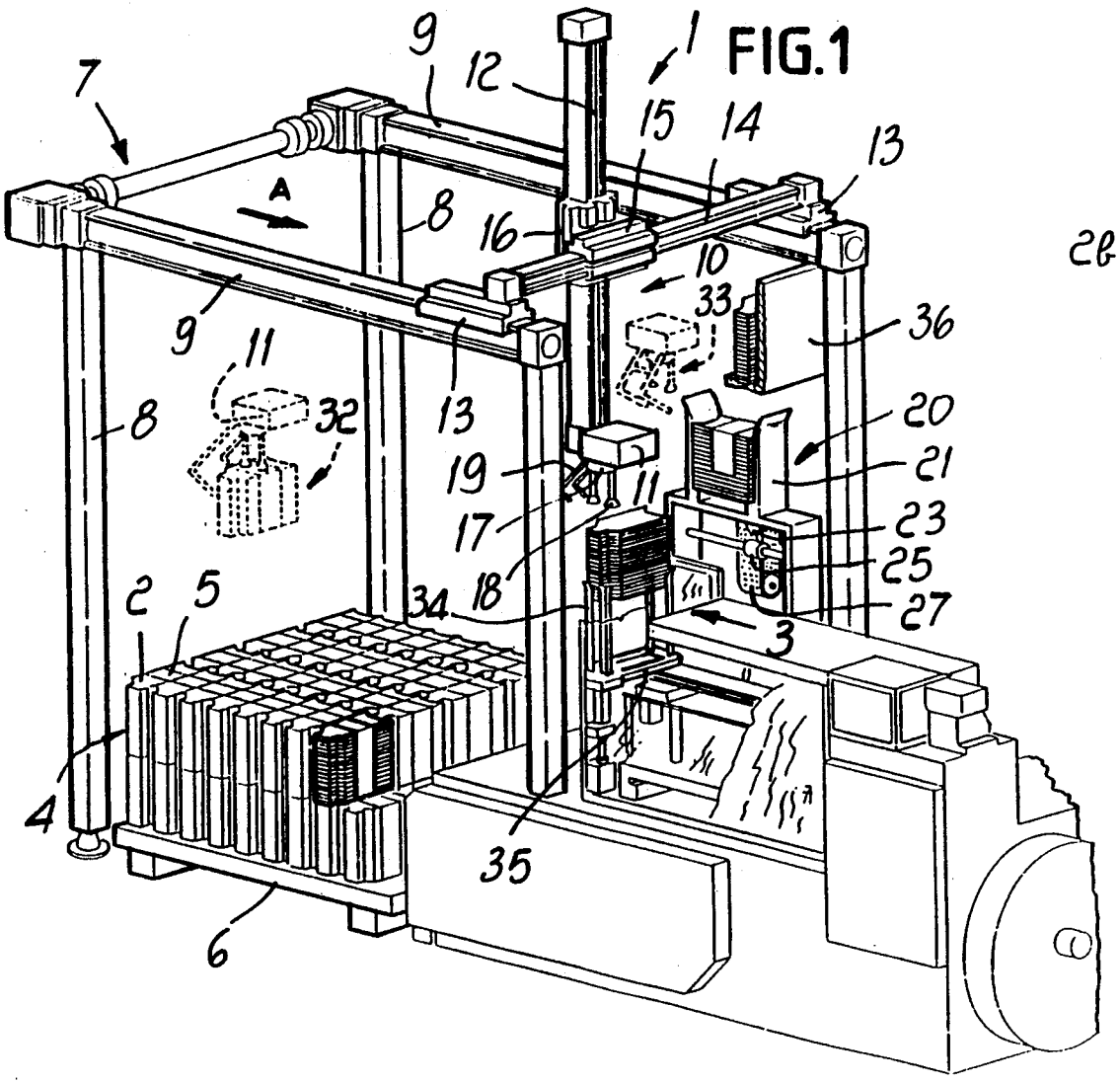
FIG. 1 is a perspective view of the apparatus for feeding packaging machines.

With reference to the above figures, the reference numeral 1 generally indicates an apparatus for automatically feeding stacks of sheet material, constituted by cardboard cutouts 2, to a hopper 3 which constitutes a station for feeding said cutouts 2 to a known packaging or packet-making machine.

The cardboard cutouts 2 have a substantially rectangular shape which has, at its ends, respectively a tab **2*a* and a trapezoidal indent 2*b*. The cutouts 2** furthermore have appropriate folding and cutting lines which are suitable for allowing subsequent packaging operations to be performed by the packaging machine.

The cutouts 2 are provided in stacks 4 which are closed by a band 5, wrapped transversely around the longitudinal sides of said cutouts. The stacks 4 of cutouts to be transferred to the packaging machine are arranged in an orderly manner on pallet-like supporting means 6. More in particular, said stacks 4 are arranged mutually side by side along said longitudinal sides, so as to form parallel rows; the rows are in turn mutually adjacent along the shorter sides of the stacks 4. The stacks 4 are furthermore arranged so as to form superimposed levels or layers.

The apparatus 1 has a fixed framework 7 from the side whereof two pairs of uprights 8 are arranged symmetrically and have, at their tops, a pair of beams 9 arranged horizontally parallel.

A unit for the removal and transfer of the stacks 4, generally indicated by the reference numeral 10, is horizontally movable on the beams 9. The removal and transfer unit 10 has a head 11 which is mounted at the lower end of a vertical beam 12.

The beams 9 slidably support respective sliders 13 which are mutually connected by a cross-member 14 and can be actuated by means of suitable actuation elements which are not illustrated in the figures.

The cross-member 14 slidably supports a sleeve 15 which can be actuated by an appropriate actuation element (not illustrated). A further sleeve 16 is rigidly associated with the sleeve 15 and is perpendicular thereto; the vertical beam 12 is slidably mounted in said sleeve 16 and can be actuated by a related actuation element (not illustrated).

The head 11 is provided, in a downward position, with a supporting element 17 which is rotatable about a vertical axis 17' under the control of an appropriate actuation element (not illustrated).

The supporting element 17 supports grip elements constituted by pneumatic means 18 and by mechanical supporting means 19 which operate in combination with one another on the individual stacks 4. The pneumatic means 18 are constituted by a plurality of sucker elements with a vertical axis which can be connected to a suction source which is not illustrated.

The mechanical supporting means 19 are in turn constituted by an L-shaped or fork-like element which is mounted so as to oscillate, under the control of actuation elements which are not illustrated, on a horizontal pivot **19*a* which is fixed to the supporting element 17**.

An end portion **19*b* of said L-shaped element is movable, as a consequence of said oscillation, between a first substantially horizontal position, at which it defines, together with said sucker elements, an accommodation seat for a stack 4**, and a second inclined position of disengagement with respect to the line of action of the sucker elements.

Figure 3:
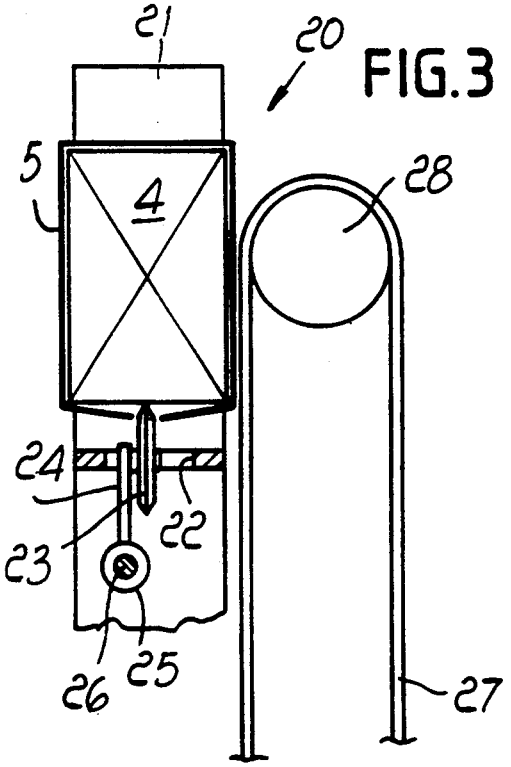
FIGS. 3 and 4 are vertical sectional views of a further detail of FIG. 1 in successive operating steps.
Figure 4:
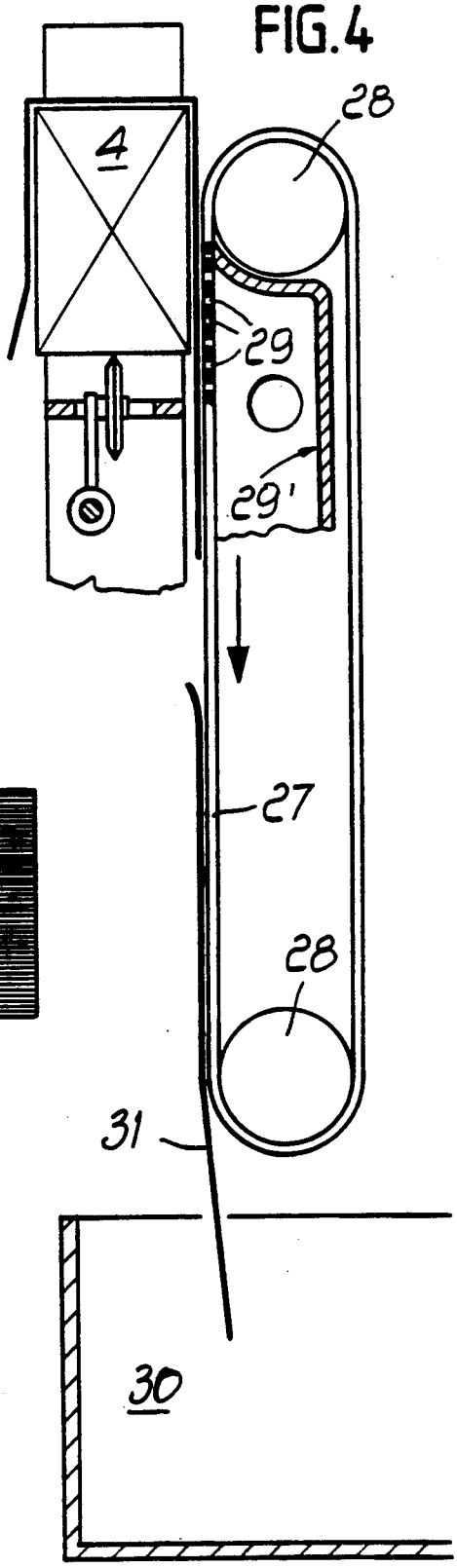

Between the position for removal of the stacks 4 from the pallet 6 and the feed hopper 3 there is a station for cutting the wrapping bands 5 which is generally indicated by the reference numeral 20 and is illustrated in detail in FIGS. 3 and 4. The cutting station 20 has a seat for the insertion of the stack 4 which is defined by a pair of walls 21 which are intended to engage said stack at the shorter sides of the cutouts 2. The seat has a lower opening 22 for the passage of a circular-blade cutting element 23. The blade 23 is rotatably supported by an arm 24 which is slidable, by means of a sleeve 25, on a stem 26 which is mounted between the walls 21 below the opening 22.

A suction belt 27 for the removal of the cut band is arranged to one side of the insertion seat of the stack 4.

The belt 27 wraps around a pair of rollers 28 and has a plurality of through holes 29.

Below the cutting station 20 there is a collecting container 30 for receiving the cut bands which are conveyed with the aid of a guide 31.

The operation of the described apparatus is as follows.

The pallet 6, on which the stacks 4 of cutouts to be transferred to the packaging machine are arranged in an orderly manner, is inserted at the base of the fixed framework 7 of the apparatus.

In this position the pallet 6 is arranged below the removal and transfer unit 10 which is movable on the beams 9.

In particular, the head 11 is adapted to be moved along three orthogonal axes and can therefore be positioned exactly on the first stack 4 to be transferred and then lowered onto it.

The movements of the head 11 are controlled by an appropriate known and commercially available control unit (not illustrated) which is normally used in three-axis measurement machines.

The stack 4 to be transferred is gripped by the sucker elements 18, which are arranged so as to act exclusively on the band 5, and raised above its supporting plane, as shown by the broken lines 32, by an extent which is sufficient to allow the rotation of the L-shaped element 19 about the pivot **19*a* and the insertion of the end portion 19*b* below said stack, as illustrated in FIG. 2**.

The stack 4, gripped by the head 11, is moved along the transfer direction A, which is parallel to the beams 9, until it moves to the side of the cutting station 20.

The stack 4 is then moved laterally above said cutting station 20, inserted in the seat defined by the walls 21 and released by the grip elements of the head 11, as shown by the broken lines 33.

It should be noted that during the transfer step the stack 4 has the longitudinal sides of the cutouts 2 arranged horizontally perpendicular to the direction A.

In order to allow the insertion of the stack 4 between the walls 21 of the cutting station 20, said stack is angularly rotated, by means of the supporting element 17, about the axis 17'.

After the stack 4 has been inserted in the cutting station 20, the supporting arm 24 of the circular blade 23 slides, under the control of an actuation element which is not illustrated, through the opening 22, so as to cut the band 5 as illustrated in FIG. 3.

The cut band is removed by the suction belt 27 and conveyed into the underlying container 30 with the aid of the guide 31.

The stack 4, freed from the band 5, is again gripped by the grip elements 18, 19 of the head 11 and extracted from the cutting station 20.

The stack 4 is subjected to a further transfer in the transfer direction A until it is vertically aligned with the feed hopper 3.

The hopper 3 comprises a plurality of angular profiled elements 34 which are arranged vertically along the vertices of a rectangle and are suitable for guiding the stacks 4. Said profiled elements 34 extend from a frame 35 for supporting the stack 4 which is arranged above a known stripper element which is suitable for separating the individual cutouts to be transferred to the processing line of the packaging machine.

The removal of the other stacks 4 from the pallet 6 and their transfer to the feeding hopper 3 are subsequently performed in a similar manner.

The described apparatus allows, in summary, to feed packaging machines with stacks of cutouts of sheet material in a fully automatic manner, the head 11 gripping the stack 4 being transferable along a path extending from the supporting means 6, by the cutting station 20, to the feeding station 3. In particular, the apparatus according to the invention performs the transfer of individual stacks, achieving operating speeds which are adequate for those of conventional packaging machines.

It should be noted that the apparatus allows to directly feed the feeder hopper 3 of the packaging machine, with obvious advantages in terms of constructive and operative simplicity with respect to known devices in which said feeding occurs by means of the interposition of conveyor belts.

By operating with the stacks wrapped by bands, the risk of cutouts arranged incorrectly upon the removal of the stacks from the pallet-like supporting means is furthermore eliminated.

It is also possible to store on a fixed ledge 36 an appropriate reserve of stacks from which it is possible to draw during the replacement of the emptied pallets 6 so as to not interrupt the operation of the packaging machine. The ledge 36 extends above the cutting station 20 transversely to the transfer direction A.

Figure 5:
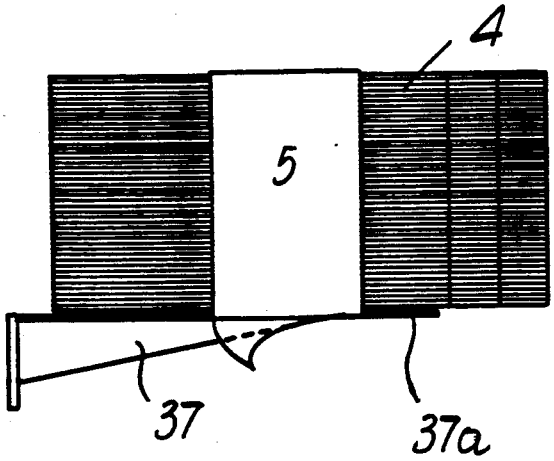
FIG. 5 is a side view of another embodiment of a detail of FIGS. 3 and 4.

FIG. 5 illustrates a different embodiment of the means for cutting the bands 5 which has a cutting blade 37 actuated with a reciprocating motion below the stack 4 by an actuation element or actuation means which are not illustrated.

The blade 37 extends, with a profile which increases in height, from a horizontal lamina **37*a* which is intended to be inserted between the lower base of the stack 4 and the band 5; the subsequent advancement of the blade 37 causes the cutting of the band 5**.

Figure 6:
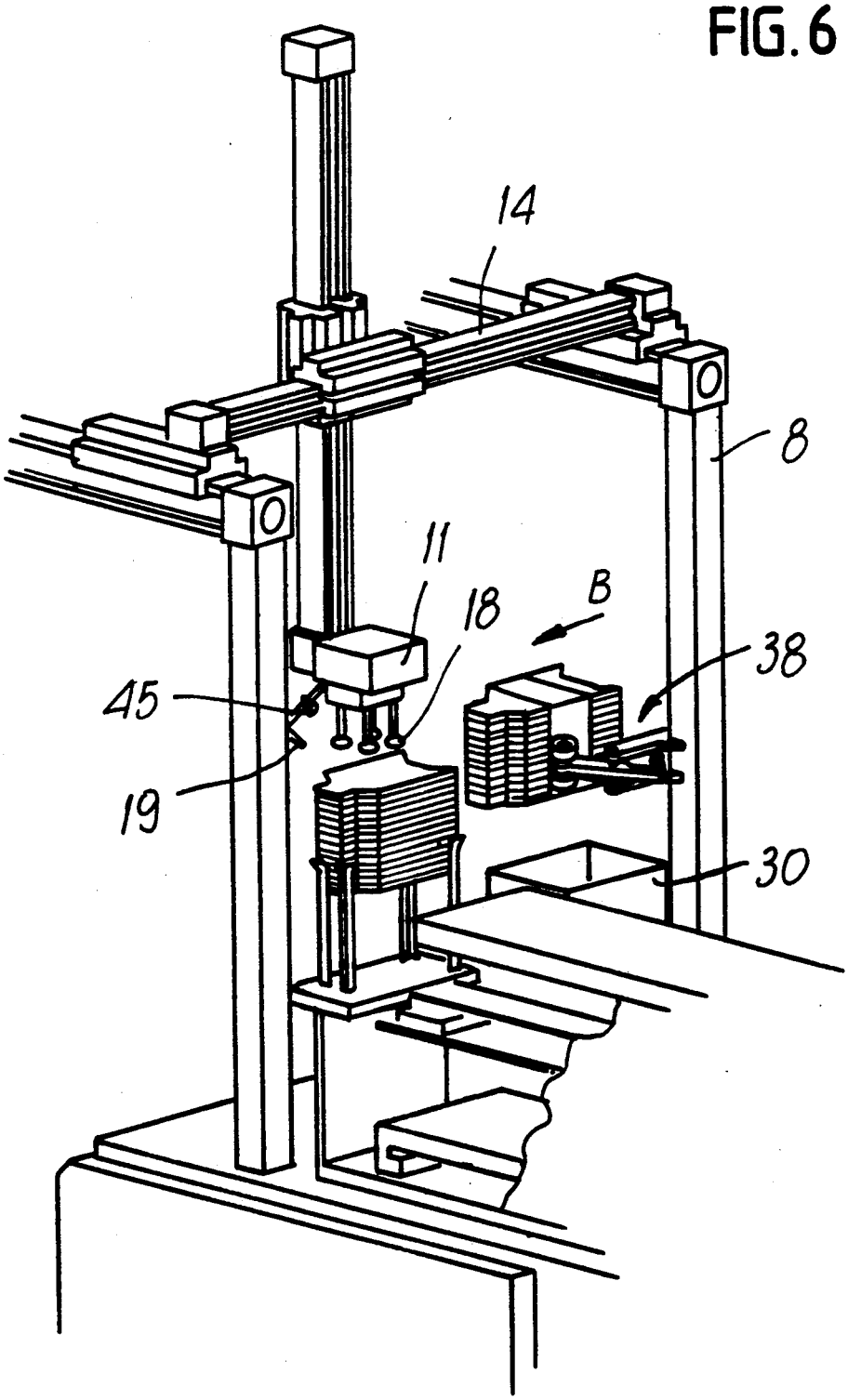
FIG. 6 is a perspective view of a further embodiment of the machine.
Figure 7:
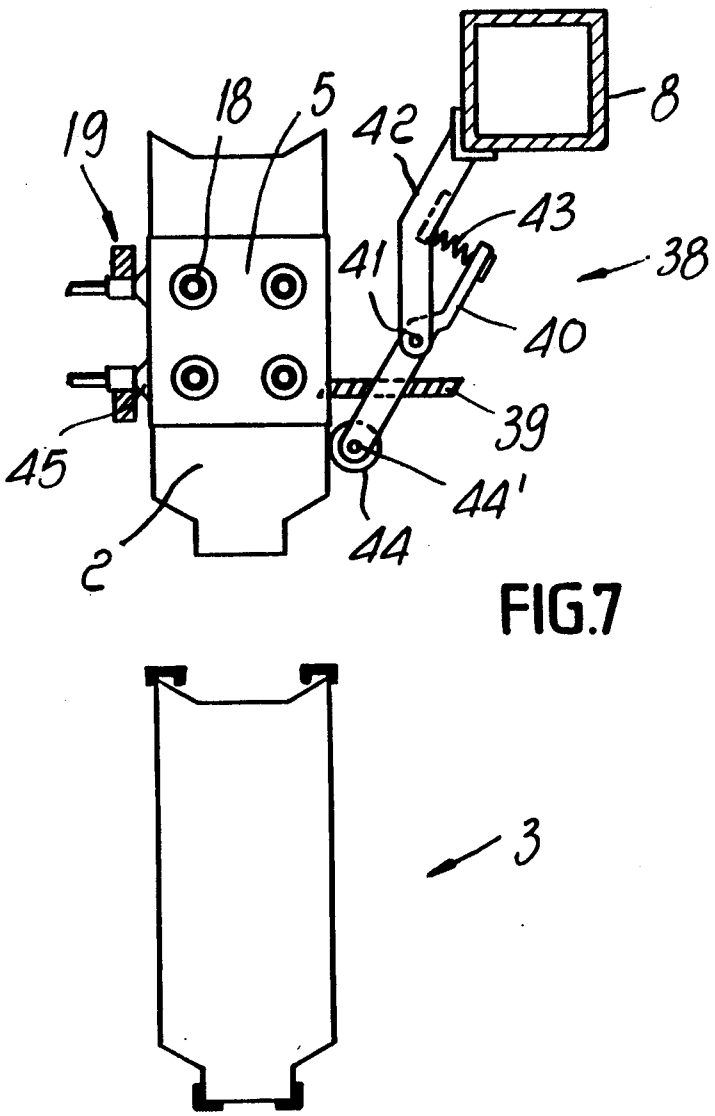
FIG. 7 is a plan view of a detail of FIG. 6.
Figure 8:
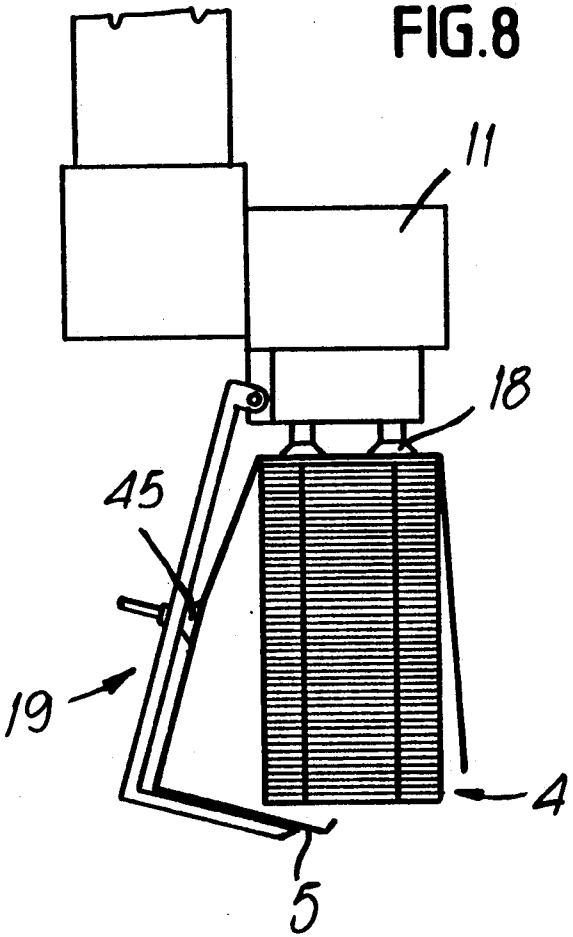
FIG. 8 is a side view of the detail of FIG. 7.

FIGS. 6 to 8 illustrate a further embodiment of the means for cutting the bands 5 which has a cutting element generally indicated by the reference numeral 38. The cutting element 38 is arranged ahead of the feeding station 3 and is suitable for operating at a step of advancement of the stack 4 along a direction B which is transverse to the transfer direction A.

The cutting element 38 comprises a blade 39 which is fixed, in an adjustable position, transversely to a lever 40.

The lever 40 is rotatable about a vertical pivot 41 on a bracket 42 which is rigidly associated with an upright 8 of the fixed frame 7, and is biased at one end by a spring 43; at the opposite end, the lever 40 supports a pair of rollers 44 which are rotatable about a vertical axis 44'.

The stack 4, gripped by the grip elements 18, 19 of the head 11, is moved in the advancement direction B, which is parallel to the cross-member 14, toward the feeding station 3.

It should be noted that in this advancement step the stack 4 keeps the longitudinal sides of the cutouts 2 horizontally perpendicular to the direction A.

During advancement in the direction B, the side of the stack 4 engages the rollers 44, causing the rotation of the lever 40 in contrast with the spring 43. In this manner the blade 39 is pivoted therewith to a position which is perpendicular to the advancement direction B of the stack 4 and cuts the band 5.

The band 5 is cut proximate to the base of the stack 4, and this allows to reduce the hanging portion of said cut band 5.

It is obviously possible to arrange the cutting element 38, as an alternative, so as to cut the band 5 at the lower surface of the stack 4.

After cutting the band 5, the stack 4 continues to be advanced in the direction B until it is moved into vertical alignment with the feeding hopper 3. Upon transfer of the stack 4 into the hopper 3, the band 5 is retained by the sucker elements 18.

The head 11 then performs the return stroke, during which the band 5 is allowed to fall into the container 30 by interrupting the connection of the sucker elements 18 to the suction source.

In order to prevent the suckers 18 from also retaining the upper cutout of the stack 4, in particular if the band is made of relatively porous paper, it is possible to provide further pneumatic means 45, constituted by a pair of sucker elements fixed to the L-shaped element 19, with axes which are parallel to the end portion 19*b*.

The sucker elements 45 operate on one side of the band 5 and are intended to retain said band 5 upon the opening of the L-shaped element 19.

In the practical embodiment of the present invention, the materials employed, as well as the shapes and dimensions, may vary according to the requirements.

Thus, for example, the actuation elements may be constituted by any suitable conventional actuation means and transmission means, such as, e.g., electric motors and kinematic transmission members.

We claim:

1. Apparatus for feeding stacks of sheet material to packaging machines, comprising:

means for supporting the stacks arranged side by side, said stacks being individually wrapped by respective wrapping bands;

a fixed framework;

a unit for removing and transferring said stacks, said unit being mounted on said framework for movement relative thereto;

a head mounted on said unit for gripping said stacks, said head being movable along three orthogonal axes, said head being transferable along a path, said stacks being thereby transferable along said path;

a cutting station comprising means for cutting said wrapping bands; and a feeding station for guiding and feeding said stacks to said packaging machines, said path along which said head is transferable extending from said means for supporting said stacks to said cutting station and then to said feeding station, said means for supporting said stacks, said cutting station, and said feeding station being located within an area defined by said fixed framework; wherein said cutting station is arranged in said path along which said stacks are transferable, so that said wrapping bands are cuttable by said means for cutting when said stacks are transferred along said path.

2. Apparatus according to claim 1, wherein said unit for removing and transferring said stacks comprises a vertical beam, wherein said beam is slidably mounted on a sleeve, and wherein said sleeve is rigidly associated with a further sleeve arranged perpendicularly thereto, and wherein said further sleeve is in turn slidable on a cross-member, and wherein said cross-member is supported, at its ends, by means of respective sliders, and wherein said sliders are slidably supported on a pair of parallel beams, said beam supporting said head at the lower end thereof.

3. Apparatus according to claim 1, wherein said head is provided, in a downward position, with a supporting element which is rotatable about a vertical axis.

4. Apparatus according to claim 3, further comprising grip elements supported by said supporting element.

5. Apparatus according to claim 4, wherein said grip elements comprise pneumatic means, said pneumatic means acting along a line of action, said line of action being exclusively situated on said wrapping bands.

6. Apparatus according to claim 5, wherein said grip elements further comprise mechanical supporting means which cooperate with said pneumatic means.

7. Apparatus according to claim 6, wherein said mechanical supporting means are mounted to said supporting element by means of a horizontal pivot, thereby said mechanical supporting means are oscillable between a first substantially horizontal position for defining together with said pneumatic means an accommodation seat for a stack, and a second inclined position of disengagement with respect to said line of action of said pneumatic means.

8. Apparatus according to claim 6, wherein said mechanical supporting means have further pneumatic means suitable for acting on one side of the stack to retain the wrapping band upon the insertion of said stack in said feeding station.

9. Apparatus according to claim 1, wherein said means for cutting comprises a cutting element comprising:

a bracket rigidly associated to the fixed framework;

a lever pivoted to said bracket and spring means between said bracket and said lever to bias one end of said lever away from said bracket, and roller elements supported at the opposite end of said lever to engage the side of a stack during the advancement thereof and causing the rotation of said lever against a biasing force provided by said spring means, and a blade which is fixed transversely to said lever and being pivoted therewith to a cutting position.

10. Apparatus according to claim 1, wherein said feeding station is constituted by an input hopper of a cigarette packaging machine.

11. Apparatus according to claim 10 wherein said input hopper comprises a plurality of angular profiled elements which are arranged vertically for guiding said stacks.

12. Apparatus for feeding stacks of sheet material to packaging machines, comprising:

means for supporting the stacks arranged side by side, said stacks being individually wrapped by respective wrapping bands;

a fixed framework;

a unit for removing and transferring said stacks, said unit being mounted on said framework for movement relative thereto;

a head mounted on said unit for gripping said stacks, said head being movable along three orthogonal axes, said head being transferable along a path, said stacks being thereby transferable along said path;

a cutting station comprising means for cutting said wrapping bands; and a feeding station for guiding and feeding said stacks to said packaging machines, said path along which said head is transferable extending from said means for supporting said stacks to said cutting station and then to said feeding station, said means for supporting said stacks, said cutting station, and said feeding station being located within an area defined by said fixed framework; wherein said cutting station is arranged in said path along which said stacks are transferable, so that said wrapping bands are cuttable by said means for cutting when said stacks are transferred along said path, said apparatus further comprising a collecting container situated below said cutting station for receiving cut wrapping bands.

* * * * *